United States Patent [19]

Gustafson

[11] 4,340,012

[45] Jul. 20, 1982

[54] OPERATION TABLE FOR BIG ANIMALS

[76] Inventor: Erik E. Gustafson, Djurgårdsgatan 15,, Mariefred, Sweden

[21] Appl. No.: 189,767

[22] Filed: Sep. 23, 1980

[30] Foreign Application Priority Data

Sep. 25, 1979 [SE] Sweden ..... 7907923

[51] Int. Cl.[3] ..... A61D 3/00

[52] U.S. Cl. ..... 119/103

[58] Field of Search ..... 119/103; 269/323, 322

[56] References Cited

U.S. PATENT DOCUMENTS 2,526,879 10/1950 Kizaur ..... 269/323 X 3,520,529 7/1970 Obel ..... 119/103 X 3,851,870 12/1974 Cook ..... 269/322

FOREIGN PATENT DOCUMENTS 2252835 6/1975 France ..... 119/103

*Primary Examiner*—Hugh R. Chamblee

*Attorney, Agent, or Firm*—Larson and Taylor

[57] ABSTRACT

The present invention regards an operation table for big animals which is immersable into a deepening (11) in the floor (10) of the operation room in such a way that, in the position or readiness of the operation table its table proper (16) intended for the execution of the operation will be situated at least substantially in flight with the level of said floor (10) but that it may be elevated into a convenient working position. The operation table comprises a support (12) and the table proper (16) for execution of the operation. The foundation is supported by the bottom of the deepening (11) by means of a scissor elevation device (13), and the table proper (16) is supported by the foundation (12) by means of a second scissor elevation device (14). The height of the foundation (12) along with the means for operating same is so chosen, that the foundation will, in its elevated position, be in level with the floor (10) in the operation room.

13 Claims, 13 Drawing Figures

0

OPERATION TABLE FOR BIG ANIMALS

Figure 1:
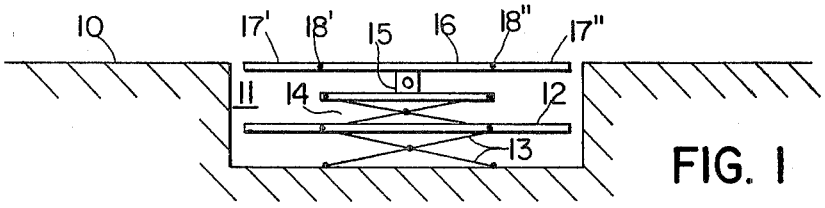

Within the surgical attendance of animals it happens at an continuously increased extent that surgical operations have to be made. When smaller domestic animals are concerned, the verterinarian or veterinary can, as a rule, without any difficulty, lift the anaesthized animal up on the operation table, this, however, is scarcely possible with respect to big domestic animals such as horses, cattle and the like and also not with respect to caught wild animals or circus animals in the same order of magnitude. In such cases one therefore used to anaestize the animal so that it will be positioned on the operation table. For reasons of ease of operation it is desired that said operation table should, at the time of anaestization, be in level with the floor of the operation room or, possibly, a little but only very little above said level. Earlier, it passed that one anaestized the animal directly on the floor of the operation room, or even of an adjacent room and by means of travelling crane or similar lift and transportation means transfered the animal to an operation table of the type just mentioned. However, it was desired to avoid this in part because the animal may be damaged or any damage existing made worse by the lifting procedure, in part also because any elevation and transport device will be bulky and form a bar against the correct handling of the animal before, during and after the carrying through of the operation. The operation table also has, practically without any exception, been positioned in an inactive so called position of readiness when the animal was transferred to it, said position being in flight with the floor level of the operation room.

In order that the veterinary shall be able effectivly to execute the operation, however, the operation table inclusive of the animal resting thereon must be adjustable in several different ways.

Firstly it happens from time to time that the operation is made in another place than the one where the anaestization was made, and in such a case the operation table has to be easily moveable.

Secondly the veterinary cannot effectively work on the low level in which the operation table was situated when the animal was laid down thereon, and the operation table, therefore, must be elevatable into a convenient level of height for working.

Thirdly the operation table must be placed on a steady foundation which is, during the course of the operation, situated in the level of the floor, so that there will be no danger for climbing down or loosing objects into the hole, in which the operations table is situated in its position of readiness. Thus, if the said foundation is elevatable and vice versa between two fixed positions, viz. firstly one in which the operation table is completely immersed in the floor, and secondly also one in which the foundation is in the level of the floor, then, obviously, the parts of the table carrying up the body of the animal have to be elevatable and vice versa in relation to the foundation so that they can be brought into the position most convenient to the work of the veterinary.

Fourthly the operation table must be adjustable and retainable in a given inclination against the horizontal level in order that the veterinary shall reach the place of the body of the animal, where the operation has to take place. Such an inclination may be necessary both in a direction coinciding with the longitudinal direction of the animal and the operation table, and in a direction perpendicular thereto it being assumed that the animal has been laid down with the longitudinal direction of its body at least substantially coinciding with the longitudinal direction of the operation table.

Fifth there has to be means provided preventing that the animal may slide on the operation table when it is inclined, or even slide off the operation table.

To all of these conditions one further adds, which is of very great importance: The veterinary institutions are not always built up keeping in mind the use of operation tables, which are capable of executing all of the adjustment movements enlisted above, but in most cases modern operation tables are mounted into existing veterinary institution buildings where there is space available for the cavity or depression in which the operation table has to rest in its postition of readiness. Therefore, it is important that the operation table shall in its state of compression and when immersed into the depression be of low height.

Thus, one is here placed before a difficult task of construction. The present invention relates to an operation table, preferably for big animals, by which all of the above enlisted conditions are satisfied in an exemplary way without any disadvantages occuring simultaneously as all of the construction of the table will be highly effective and also simple and thus cheap.

According to the invention, the operation table comprises a bottom and a table proper. These two parts are, in common, immersable into a recess or deepening in the floor of the operation room. The bottom is supported by a hydraulically controllable scissor construction, by means of which it may at least be transferable between its two end positions one of which corresponding to the position of readiness of the operation table and the other one corresponding to the position of the bottom in flight with the floor of the operation room. The operation table proper is either rigidly mounted on the bottom or it may be releasably mounted thereon, for instance to be driven on wheels, and it is in turn provided with a hydraulically or pneumatically controllable scissor construction by means of which the operation table proper may by adjusted into a deliberate height above the bottom. The combined height of the bottom and of the operation table proper with the scissor constructions required for controlling them is such that the operation table will, at least substantially, be in flight with the floor of the operation room when in its position of readiness.

The invention will be further described below in connection with an embodiment shown in the attached drawings, but it is understood, that the scope of the invention shall not be limited to this specific embodiment but that all different kinds of modifications may exist within the frame of the invention.

Figure 5:
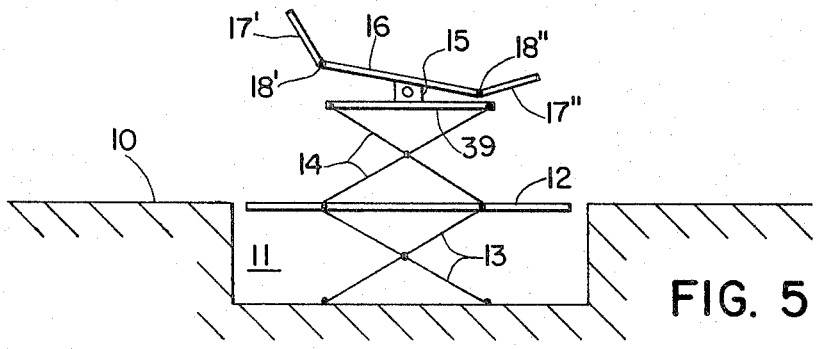
Figure 6:
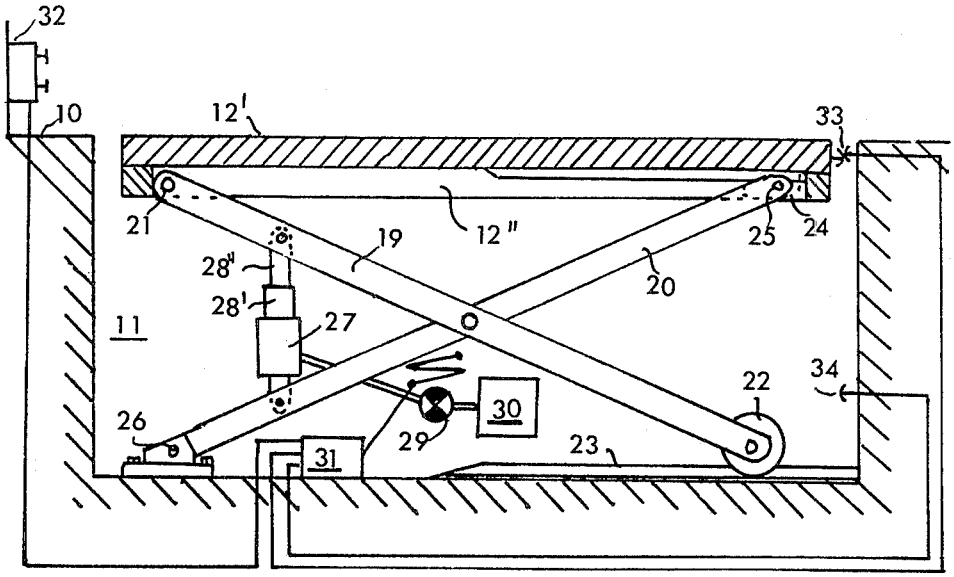
Figure 7:
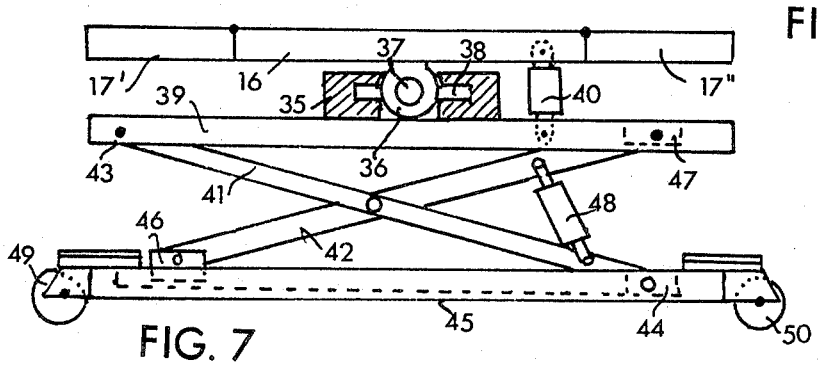
Figure 9:
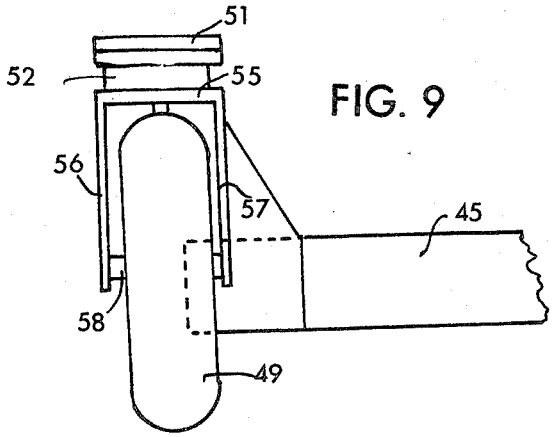
Figure 8:
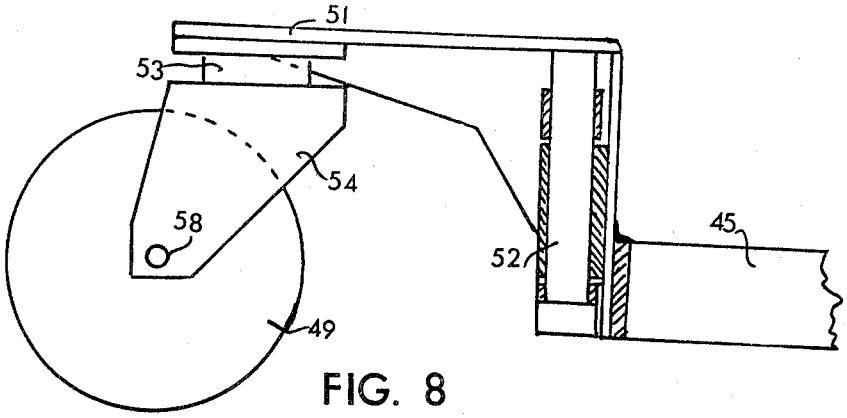
Figure 10:
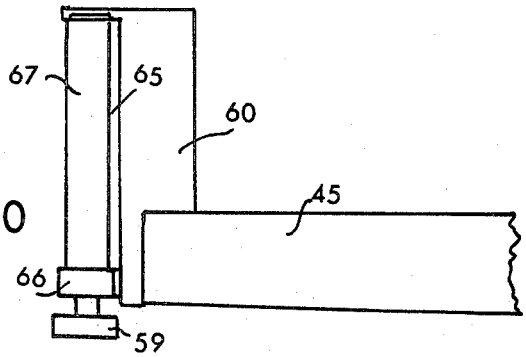
Figure 11:
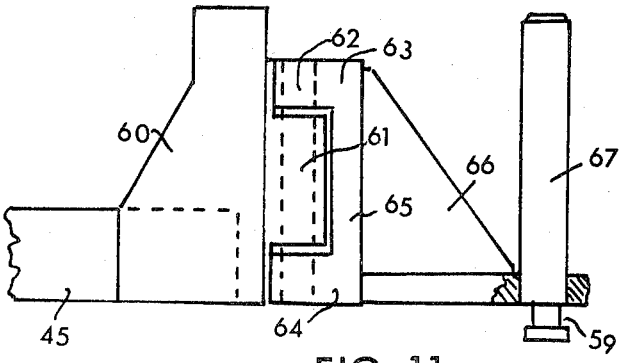
Figure 12:
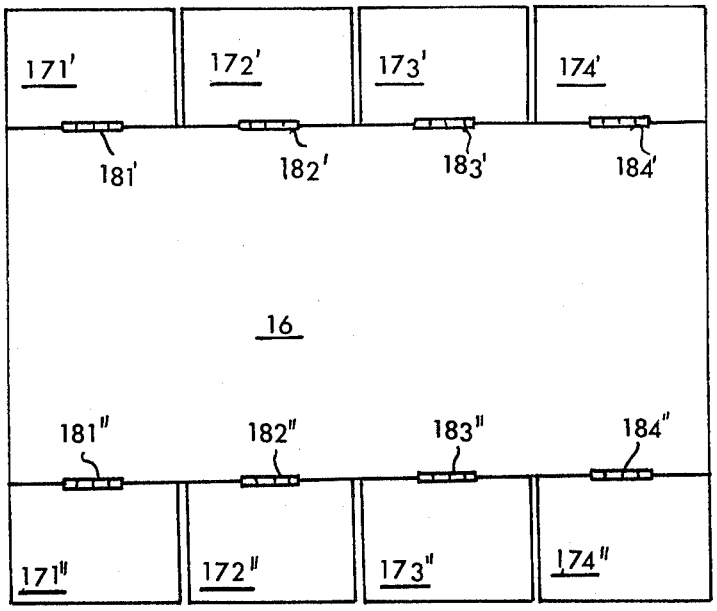
Figure 13:
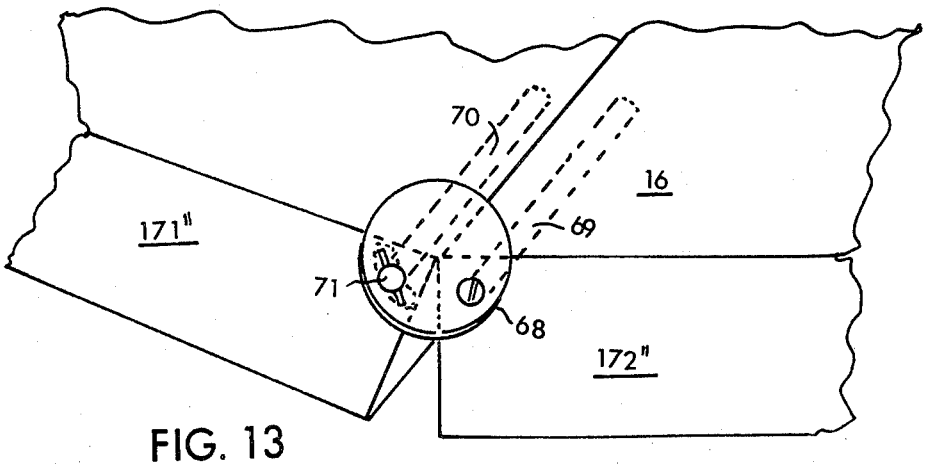

In the drawings, FIGS. 1–5 show, in a very schematic form, different steps during the adjustment of the operation table from its state of readiness as shown in FIG. 1 into a working state as shown in FIG. 5. FIG. 6 shows the deepening with the scissor construction and the bottom or support placed therein, however, without the table, and FIG. 7 shows the table with its scissor construction, which is intended to be placed on the support or bottom shown in FIG. 6. The table, in this case, is supposed not to be rigidly mounted on the support but to be provided with wheels so that the animal may be laid down in another place than the one where the operation table is when in working state in order thereafter to be transported to the place for execution of the operation. FIGS. 8 and 9 show the wheel construction in projections perpendicular to each other, and FIGS. 10 and 11 show a leg construction, which may be folded down into active position to prevent movement of the wheels after the table has assumed its working position. FIGS. 12 and 13 show the table with its side flanges, which are turnable about hinges running in the longitudinal direction of the table in order of re-shaping it so that it will support the animal resting on the table during the act of operation.

As mentioned above, FIGS. 1–5 are exclusively schematic and do not indicate the construction of the operation table. They are rather intended, like a movie, to show the different phases during the mounting of the table from its state of readiness into its working state. In FIG. 1, thus, the floor 10 of the operation room is shown along with the deepening 11 provided therein. In the deepening the support 12 is provided carried up by a first scissor construction 13. The support 12, in turn, carries by means of a second scissor construction 14 and cardanic joint 15 the table proper, which comprises a middle part 16 and, at the long sides of same flanges 17', 17'', which may be folded upwardly so that they will assume positions, in which they support the animal laid down, if the main part 16 of the table should, by means of the cardanic joint, have been mounted in an inclined position. It is seen that all of the parts of the operation table now mentioned are, is the state of readiness, immersed into the deepening 11 so that the table will be in alignment with the floor 10 of the operation room.

Figure 2:
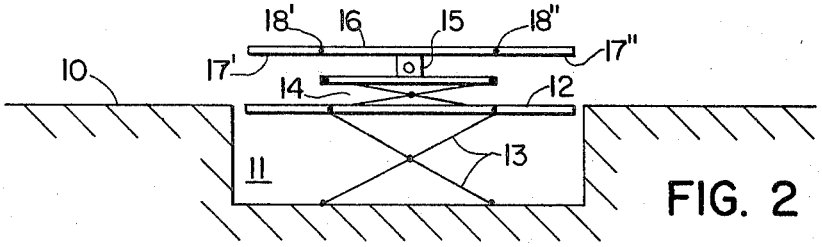

When the operation table shall be turned over into its working position it is suitable first by means of an hydraulic servo cylinder not shown in FIGS. 1–5, to elevate the support 12 so that this will be transferred from its one end position shown in FIG. 1 into its other end position shown in FIG. 2 in which the support 12 is in flight with the floor 10 of the operation room. It is obvious that the animal should, when an operation table according to the present invention is used, be laid down on the operation table when this is in its state of readiness according to FIG. 1, and the subsequent FIGS. 2–5, therefore, simply show different states of the operation table during its transfer along with the animal laid down thereon to the working position, which will be shown in FIG. 5.

Figure 3:
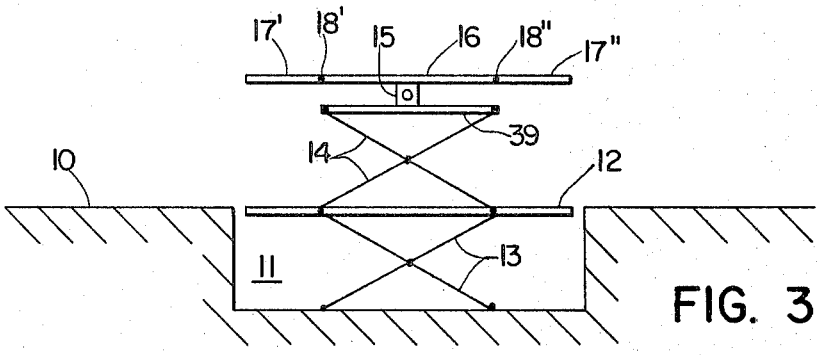
Figure 4:
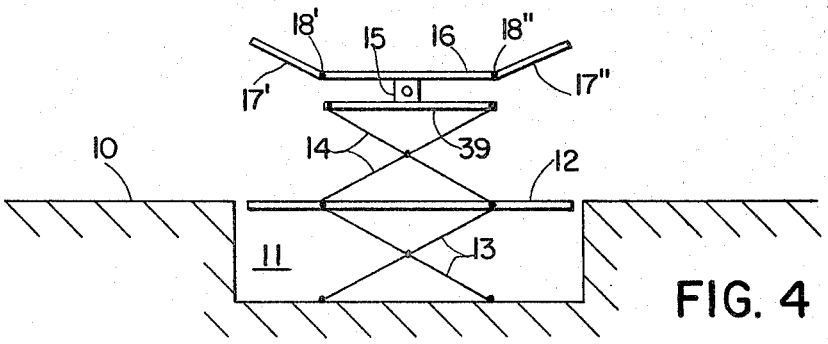

The next step, thus, is the elevation of the table 16, 17', 17'' into a suitable working height above the level of the floor 10, and this is shown in FIG. 3. The elevation takes place by means of the scissor construction 14. The working height, thus, has been achieved. It should be observed that the scissor construction 13 is preferably so made that it will only possess two end positions, viz. the one shown in FIG. 1 and the one shown in FIG. 2, whereas the scissor construction 14 should be of such a kind that it may be stopped and retained in any desired intermediate position between the ones shown in FIGS. 1 and 2, on the one side, and the position shown in FIG. 3, on the other side.

Now, it may be assumed that, as is often the case, the veterinary finds it desirable to incline the table 16, 17', 17'' along with the animal resting thereon to make it possible to fullfill the surgical operation in a convenient and reliable way. Such an inclination may take place by means of the cardanic support device 15 as will be explained below. Before the inclination of the table is performed, however, the veterinary should make sure that the animal will not slide on the table or, still worse, slide off the table, and it is for that reason that the table flanges 17', 17'' are provided. At this time, they are not loaded by the weight of the animal, and it will therefore be an easy matter to adjust them by hand by means of the hinges 18', 18''. These hinges should be provided with some type of a friction lock, known per se which may be put into locking position so that the flanges 17', 17'' remain in their adjusted positions, see FIG. 4.

Hereafter, the table 16, 17', 17'' may be inclined for instance into the position shown in FIG. 5. As a matter of fact, the cardanic device 15 is applied between the table 16, on the one side, and a support 39, on the other side. This support may be shaped like a disc or a frame or in any other way which forms no part per se of the present invention.

Hereafter, the operation table is in its working position, and the surgical operation may be executed. It may happen, during the run of the operation, that one wants to elevate or lower the table 16, 17', 17'', and this then may be made easily by means of the hydraulically operatable scissor parts 14, and it may also happen that the veterinary wants to change the inclination of the table 16, 17', 17'', and to this effect there are two hydraulically functioning servo motors, not shown in FIGS. 1–5, by means of which the inclination of the table may take place, either as shown in FIG. 5 in the crossward direction of the table, or also in the longitudinal direction of the table. It is not inavoidably necessary that these hydraulic servo motors are so arranged, that the two movements of inclination take place in levels, perpendicular to each other, but this may anyhow be of great practical importance in order to make the control more easy.

In FIG. 6, a form of the arrangement of the deepening 11 in the floor 10 and of the support 12 along with the scissor construction for its elevation are shown in a more detailed way. It is also possible to use a plurality of scissors, the most simple form, anyhow, will be the one in which only two scissors are used, one of them shown in FIG. 6 comprising the scissor shanks 19 and 20 whereas the other one is hidden by these two shank bars. Many different types of scissor constructions are known for elevation purposes, and, of course, it is possible to use any deliberate such construction, and the construction shown, therefore, has only to be regarded a chosen embodiment.

In the shown scissor construction the shank 19 is hinged to the support 12, which is assumed, in this case, to comprise a scissor plate 12' and a frame 12'' provided around its circumference. The joint is marked by 21. The other end of the shank 19 is provided with a pulley or a little wheel 22 running in a track 23 in the bottom of the deepening 11. The other shank 20 is provided with a slide shoe 24 in which the axis 25 of the joint is geared. This slide shoe is guided in a track within the frame 12''. The lower end of the shank 20 is geared in a fixed bearing 26 in the bottom of the deepening 11. Between the two shanks 19 and 20 there is provided a hydraulic servo motor 27. For gaining space and making all of the construction now described possible to depress to a minimum of height, when the operation table shall be transferred into its position of readiness it is suitable that the moveable shaft of the servo motor 27 be made in the form of a telescopic shaft. Therefore, it is shown to be composed by two parts 28', 28''. The servo motor 27 is fed with a medium under pressure over a valve 29 from a source of pressure medium 30. The valve 29 is controlled by means of a magnetic coil 30a, the current of which is controlled from a coupling frame 31, which is connected firstly to a coupling panel 32 with two control push buttons, one of which for elevation of the support and the other one for ist lowering, and secondly to the two end position contacts 33 and 34 for stopping the movement of elevation or lowering, respectively, when the support 12 has reached the end position concerned.

It is assumed, in the embodiment now described that the table 16, 17', 17" along with the parts directly combined therewith is intended to be driven on wheels from the place where the animal is laid down to the support 12. An arrangement for this purpose is shown in FIG. 7. The above mentioned support 39 carries up a bearing device 35 for the cardanic support of the table 16, 17', 17". This is only schematically indicated, it being assumed that it is of some type known per se. Thus, it is only shown to comprise a ball joint with ball 36, said ball being turnably beared for movement in two different direction, represented by the two shafts 37 and 38. The turning about the shaft 37 is caused by means of an hydraulic servo motor 40 which is connected to the table 16 as well as to the support 39. A corresponding hydraulic servo motor not shown in the drawing is provided for turning the table about the shaft 38. The support 39 is supported by means of a scissor device comprising two pairs of shanks, only the shanks 41 and 42, however being visible in one of said pairs in FIG. 7. The shank 41 is beared at 43 in a slide shoe 44 on the chassis 45, on which the arrangement rests, and the shank 42, in a corresponding way, is beared in a fixed bearing 46 on the chasis and in a slide shoe 47 on the support 39, respectively. Between the shanks 41 and 42 a hydraulic servo motor 48 is provided by means of which one may elevate or lower the position of the support 39 and thereby also of the table 16.

The chassis 45 is provided with wheels 49, 50 the construction of which will appear from FIGS. 8 and 9. There are four such wheels but in FIG. 7 only two of them are visible in FIG. 7, the two remaining wheels being hidden. The wheel construction comprises a bracket 51 which is, on the one side, turnably connected to the chassis 45 by means of a vertical guide bolt 52 and, on the other side, carries up a hub 54 turnable about a second vertical guide bolt 53, said hub in turn supporting one of the wheels, for instance the wheel 49. The hub 54, preferably, is made with a beam 55, see FIG. 9, which is connected to the vertical guide bolt 52 and is provided with two arms 56 and 57, the shaft 58 of the wheel 49 running through them. A fixture arrangement known per se is provided for retaining the bracket 51 either in its expanded position as shown in FIG. 8 or in its contracted position as shown in FIG. 9. The expanded position according to FIG. 8 is the normal travelling position of the table, the expansion of the wheels 49, 50 and so on giving a larger support surface, but as the wheels would act as a bar for the work of the veterinary during the run of the surgical operation, they may be turned inwardly into the position shown in FIG. 9 during said surgical operation.

For making this turning of the wheels 49, 50 and so on possible a support arrangement is made for a small elevation of the chassis 45 above the level of the floor 10 so that the wheels 49, 50 and so on shall no longer be in contact with the floor 10 or the support 12, respectively. This support arrangement is shown in FIGS. 10 and 11.

Also in this case the construction carrying up support feet 59 is turnable between a first position in which a large support surface is obtained between the feet and a second position in which the feet are turned inwardly in tight attachement with the chassis 45 so that they will no longer prevent the work at the operation table, especially during its movement on the wheels 49, 50 and so on.

Thus, a bracket 60 is attached to the chassis 45. This bracket comprises an extension 61, which is bored through in vertical direction to give place for a shaft 62. This shaft 62 also runs through an upper arm 63 and a lower arm 64 of a yoke 65 which supports, in turn, a bracket 66, said bracket being finished at its lower end by the support foot 59 supporting the servo motor 67. The servo motor 67 comprises a hydraulic cylinder and a piston, which may be lowered or elevated under influence from a pressure medium fed to or removed from the cylinder through conduits and valves, which are, however, not shown in the drawing because it will be apparent to any man skilled in the art how they should be arranged. The support foot 59 is applied at the end of the piston and is moveable within the cylinder so that, when pressure medium is fed to the cylinder of the servo motor will the piston be pressed downwardly and, by means of the support foot 59, elevate all of the chassis along with the parts of the operation table pertaining thereto as well as the animal, which may perhaps rest thereon. It should be observed that at least four such support arrangement should be provided, suitably distributed to the four corners of the chassis. The support arrangement is shown in FIG. 10 in its position folded inwardly against the chassis and in FIG. 11 in its out fold position.

FIG. 12 is a plan view of the table 16 with its flaps. In this case it was assumed that the table was provided at each of its long sides with four individually turnable flaps 171', 172', 173' and 174' and also 171", 172", 173" and 174". These flaps are turnably attached to the main part 16 of the table by means of hinges 181', 182', 183' and 184' as well as 181", 182", 183" and 184". By means of these hinges each of the flaps may be adjusted to the most preferable position. When these positions have been assumed, the flaps may thereafter be locked in some releasable way, and this for instance may take place by a friction lock plate 68 (see FIG. 13) being provided at one or both ends of the limitations between the main table 16 and the flaps. This plate is provided with two bolts 69 and 70, respectively, running all through. The bolt 69 is rigidly anchored in the middle part 16 of the table, whereas the bolt 70 runs through the circularily segment shaped slots in each of the flaps 171", 172" and so on. A wing nut 71 is arranged for tightening the flaps on the side against each other and on the other side against the friction lock plate 68 so that after the wing nut has been tightened there will be a satisfactory friction bond firstly between each pair of adjacent flaps and secondly also between the outer flaps and the friction lock plates 68 adjacent to them.

In the above, all of the servo motors have been described as hydraulic. However, it is obvious that they may with same function be replaced by pneumatic servo motors, even if such motors cannot, as a rule, provide as strong forces as the pneumatic servo motors. Also such smaller operation tables, which may be adapted for a little smaller animals than horses, cattle and the like, therefore shall be regarded to be included in the present protection.

I claim:

1. An operation table for big animals which is stored in a recess in a floor so as to be level with the floor comprising:

a flat foundation of slightly smaller dimensions than the horizontal dimensions of the recess;

a flat table intended for the surgical operation located above said foundation;

a foundation moving means for moving said foundation at least from a lower position within the recess to an upper position substantially level with the floor; and a table moving means for selectively moving said table from a loading position substantially level with the floor where said foundation is in the lower position within the recess to an operating position which is adjusted to a convenient height for the operation where said foundation is in the upper position level with the floor, said foundation moving means comprising a hydraulically operated scissor device located below said foundation and said table moving means comprising a hydraulically operated scissor device located above said foundation.

2. An operation table as claimed in claim 1 wherein said table is permanently mounted to said foundation.

3. An operation table as claimed in claim 1 wherein said table is releasably mounted to said foundation and further including wheel means (49, 50) attached to said table for allowing said table to move easily when said table is released from said foundation.

4. An operation table according to claims 2 or 3 characterized in that the scissor device for moving the foundation into a position above the bottom of the recess is arranged to be movable solely to the end positions thereof and the scissor device for moving the table above the foundation is arranged to be retained in a selectable position between the end positions thereof.

5. An operation table according to claim 4 characterized in that the scissor device for moving the table above the foundation is disposed between said foundation on one side and a support on the other side, said support, in turn, supporting the table by means of a cardanically movable arrangement.

6. An operation table according to claim 4 characterized in that the cardanically movable arrangement is adjustably in cooperation with at least one hydraulic servo motor in at least two planes perpendicular to each other.

7. An operation table according to claim 6 characterized in that the table and the support are releasably arranged in relationship to the foundation and provided with a chassis supported by wheels for movement on parts of the floor of the operation room, the table being provided with legs which are elongatable or contractable so that they may be elevated into a position in which the wheels contact the floor of the operation room, or lowered to a position in which the wheels are elevated above the floor of the operation room.

8. An operation table according to claim 7 characterized in that the wheels are supported by brackets connected to the chassis, said brackets being rotatable about at least substantially vertical shafts between a first position in which the brackets provide a large support surface for the table, and a second position, in which the brackets are folded inwardly securely against the table.

9. An operation table according to claim 7 characterized in that the legs are supported by brackets connected to the chassis, said brackets being hinged about at least substantially vertical shafts for movement between a first position in which the brackets provide an extended support surface for the table and a second position in which the brackets are folded inwardly securely against the table.

10. An operation table according to claim 4 characterized in that the table is slightly smaller than the horizontal size of the recess and comprises a main part which is provided with means for elevating or lowering the same, and a plurality of flaps arranged on each side of said main part and being pivotable about hinges along said sides of the said main part of the table.

11. An operation table according to claim 10 characterized in that the main part of the table is of rectangular shape, and that the flaps are provided along the long sides thereof.

12. An operation table according to claim 10 characterized in that the flaps are adjustable by hand and lockable in their adjusted positions.

13. An operation table according to claim 12 characterized in that a friction lock device is provided for causing the locking of the flaps in their adjusted positions in relation to the main part of the table.

* * * * *